US005322759A

United States Patent [19]

Barnett et al.

[11] Patent Number: 5,322,759

[45] Date of Patent: Jun. 21, 1994

[54] PHOTOGRAPHIC DONOR MATERIAL WITH NON-PHOTOSENSITIVE SILVER HALIDE LAYER USEFUL IN A SILVER SALT DIFFUSION TRANSFER PROCESS

[75] Inventors: Anthony M. Barnett, Bushey; David A. Hallbery, Wembley; Roger J. Owers, Leighton Buzzard, all of United Kingdom

[73] Assignee: Eastman Kodak Company, Rochester, N.Y.

[21] Appl. No.: 946,365

[22] PCT Filed: May 24, 1991

[86] PCT No.: PCT/EP91/00977

§ 371 Date: Nov. 9, 1992

§ 102(e) Date: Nov. 9, 1992

[87] PCT Pub. No.: WO91/19225

PCT Pub. Date: Dec. 12, 1991

[30] Foreign Application Priority Data

May 31, 1990 [GB] United Kingdom ..... 9012163
Sep. 22, 1990 [GB] United Kingdom ..... 9020709

[51] Int. Cl.[5] ..... G03C 5/54; G03C 1/46

[52] U.S. Cl. ..... 430/244; 430/230; 430/509; 430/523

[58] Field of Search ..... 430/230, 509, 414, 416, 430/523, 244

[56] References Cited

U.S. PATENT DOCUMENTS

| | | | |
|---|---|---|---|
| 3,050,391 | 8/1962 | Thompson et al. | 430/509 |
| 3,140,179 | 7/1964 | Russell | 430/509 |
| 4,299,908 | 11/1981 | Ito et al. | 430/234 |
| 4,728,596 | 3/1988 | Takaki et al. | 430/230 |
| 4,772,535 | 9/1988 | Yamano et al. | 430/230 |
| 4,873,181 | 5/1989 | Miyasaka et al. | 430/523 |
| 5,051,335 | 9/1991 | Kato | 430/509 |
| 5,068,165 | 11/1991 | Coppens et al. | 430/230 |

FOREIGN PATENT DOCUMENTS

| | | |
|---|---|---|
| 0187879 | 4/1988 | European Pat. Off. . |
| 614155 | 12/1948 | United Kingdom . |

*Primary Examiner*—Richard L. Schilling
*Attorney, Agent, or Firm*—Alfred P. Lorenzo

[57] ABSTRACT

A photographic donor material useful in forming continuous tone images in a silver salt diffusion transfer process is comprised of a support; a photosensitive silver halide emulsion layer in which the silver halide is at least 80% silver chloride and is substantially free of iodide; and, located between the photosensitive silver halide emulsion layer and the support, a silver halide emulsion layer which is non-photosensitive under the conditions in which the donor material is used.

6 Claims, No Drawings

PHOTOGRAPHIC DONOR MATERIAL WITH NON-PHOTOSENSITIVE SILVER HALIDE LAYER USEFUL IN A SILVER SALT DIFFUSION TRANSFER PROCESS

FIELD OF THE INVENTION

This invention relates in general to photography and in particular to a photographic donor material that is useful in the silver salt diffusion transfer process.

BACKGROUND OF THE INVENTION

The principle of the silver salt diffusion transfer process is described in British Patent No. 614,155 filed Nov. 2, 1939. This process comprises the steps of exposing a photosensitive element containing a silver halide emulsion layer, developing the exposed photosensitive silver halide emulsion layer and forming a soluble silver complex of unexposed silver halide by treating the said photosensitive silver halide emulsion layer with an alkaline processing fluid in the presence of a developing agent and a silver halide complexing agent, transferring said soluble silver complex by diffusion to the silver receptive layer of an image-receiving element in superposed relationship with said silver halide emulsion, forming at said silver receptive layer an image incorporating silver from said silver complex under the action of development nuclei, and separating said image-receiving element from said photosensitive element. As explained in British Patent No. 614,155, the development nuclei are uniformly distributed throughout the silver receptive layer of the image-receiving element.

A more detailed description of the silver salt diffusion transfer process is provided in Chapter 16 (Author: G.I.P. Levenson) of "The Theory of the Photographic Process", Ed. T. H. James, 4th Edition, Macmillan, N.Y.

The silver salt diffusion transfer process has long been used in the field of graphic arts. In most applications in this field, images of high contrast are required, but there is also a need to produce continuous tone images by use of the-same processing conditions used for the high contrast images.

One method of reducing the contrast of a photographic silver halide layer is by using silver halide grains of different photographic speed. These grains can be blended and coated in a single layer or two separate layers can be coated, comprising a faster layer and a slower layer. This approach is taken in the materials described in European Specification 0 187 879.

U.S. Pat. No. 4,873,181 describes a photographic material comprising a support, a light-sensitive silver halide emulsion layer that contains silver iodide overlying the support, and an auxiliary layer containing non-light-sensitive silver halide grains having an average grain size of not more than 0.5 μm. The purpose of the auxiliary layer is to provide high covering power, improved graininess and improved development stability.

SUMMARY OF THE INVENTION

The present invention provides a photosensitive donor material for the silver salt diffusion transfer process which can provide continuous tone images in the receiver because of the novel construction of the photosensitive donor material.

According to the present invention, there is provided a photosensitive donor material which comprises a support bearing a photosensitive silver halide emulsion layer substantially free of iodide and, located between the photosensitive emulsion layer and the support, a layer of a silver halide emulsion which is non-photosensitive under conditions of use.

DESCRIPTION OF THE PREFERRED EMBODIMENTS

In use, the photographic donor material of this invention is exposed to an image and processed by bringing it into face-to-face contact with a receiving layer in the presence of an alkaline processing solution. As with conventional diffusion transfer donors, the exposed areas of the photosensitive emulsion layer develop to metallic silver. Meanwhile, in the unexposed areas of the photosensitive emulsion and throughout the whole of the non-photosensitive emulsion, undeveloped silver halide is solubilized by the silver halide solvent in the processing solution. The soluble silver complexes so formed then begin to diffuse to the receiving layer, which contains silver precipitating nuclei where a metallic silver image is formed.

In all diffusion transfer materials, the ratio of the silver complexes to silver is high at the start of development. However, in areas where there has been exposure to light, silver centers will be produced fairly rapidly on development. The silver centers act as nuclei for physical development in the donor before the silver complexes can diffuse to the receiver layer, and this gives rise to the high contrast found in diffusion transfer materials.

In the present material, the ratio of silver complexes to silver is increased in areas where there has been light exposure because of the use of a non-photosensitive silver halide layer. Thus, some of the silver complexes are able to diffuse to the receiver layer in areas of intermediate exposure, giving a lower contrast than in conventional diffusion transfer materials.

In the photographic donor material of this invention, the photosensitive silver halide emulsion layer is at least 80% silver chloride, and preferably it is substantially pure silver chloride. It is particularly important to avoid any significant iodide content in the photosensitive silver halide emulsion layer employed in the present donor material, i.e., it is substantially free from iodide. This is because iodide content in the photosensitive silver halide emulsion will slow down the rate of development, and this will interfere with the diffusion transfer image-forming process. In this process, development needs to be rapid so that it will be completed before any dissolution and transfer of unexposed and undeveloped silver halide occurs.

The present invention further provides a method for forming an image by the silver salt diffusion transfer process in which a donor of the present invention is imagewise exposed, placed in face-to-face contact with a receiving sheet comprising a layer containing silver precipitating nuclei, in the presence of an alkaline processing solution, and thereafter separated to provide an image-bearing receiving sheet.

The non-photosensitive emulsion layer is insensitive to at least the degree that it forms no image on exposure and processing under conditions of use. If its speed was measured, however, it could be found to have a speed of 2 log E, preferably at least 3 log E, less than the photosensitive emulsion.

A continuous tone image can be obtained under a range of processing conditions, such as high and low temperatures or fresh or near exhausted processing solutions, and still provide acceptable results. There is, however, a degree of control excercisable over the contrast by varying the time the donor and receiver are held in contact.

The non-photosensitive emulsion layer may or may not have the same silver halide content as that of the photosensitive emulsion. As a matter-of practice, it is sufficient to omit any sensitizing dye from the emulsion to make it non-photosensitive. Emulsions which may be employed in both the photosensitive and non-photosensitive layers are generally described in Research Disclosure Item 308119, December 1989, Industrial Opportunities, Dudley Annexe, 21a North Street, Emsworth, Hampshire P010 7DQ, United Kingdom.

The photosensitive emulsion layer may be coated at silver laydowns of from 140 to 240 $m^2$, preferably from 160 to 190 $mg/m^2$ and gelatin laydowns of from 1 to 3 $g/m^2$. As is usual, a layer of the donor material, e.g., the emulsion layer or an underlayer, may have incorporated therein a developing agent or developing agent combination. The non-photosensitive emulsion layer may be coated at silver laydowns of from 260 to 450 $mg/m^2$, preferably from 324 to 405 $mg/m^2$ and gelatin laydowns of from 3 to 5 $g/m^2$. An antihalation dye can be incorporated therein to improve the sharpness of the image. The ratio of non-sensitive to sensitive emulsion silver halide will affect the contrast of the image obtained.

The support, method of coating, additives, etc, may be as described in the Research Disclosure item above.

The following Example is included for a better understanding of the invention.

EXAMPLE

A silver chloride emulsion of grain size 0.34 micrometers was prepared. Using this emulsion, Melt (A) was prepared by adding a potassium bromide solution at the rate of 1.8 g per mole of silver. An orthochromatic sensitizing dye (peak absorption of 509 nm) was added at 0.4 g per mole of silver. To this, benzothiazolium iodide was added at 0.08 g per mole silver. One percent (1%) of TRITON X100 TM was then added, followed by sufficient gelatin to make a 10% gelatin solution.

A second Melt (B) was prepared using the same basic silver halide emulsion as above, adding 1.2 g potassium bromide per mole of silver. Sufficient gelatin was added to make a 6.5% gelatin solution.

Solution (C) was prepared consisting of an aqueous solution of hydroquinone (71.5 g), sodium formaldehyde bisulfite (23.6 g) and 1-phenyl-3-pyrazolidone (0.64 g) in 1 liter.

Melt (B) was coated on a resin-coated paper support at a laydown of 0.405 $g/m^2$ silver and 5.0 $g/m^2$ gelatin. On top of this layer was coated the solution obtained by mixing Melt (A) and Solution (C) at a laydown of 0.162 $g/m^2$ silver and 3.0 $g/m^2$ gelatin. During coating, the hardener bisvinylsulfonylmethyl ether (BVSME) was added to Melt (B) at a rate of 0.008 $g/m^2$ silver.

Strips of the final coating were exposed to a step wedge of incremental density 0.11 log E and processed using Kodak TM PMTII Activator in a Kodak Imagemate TM 43DT diffusion transfer processor and laminated to a Kodak TM PMTII paper receiver sheet. Contrasts of from 0.6 to 1.8 were obtained by varying the strip time between 15 seconds and 1 minute.

What is claimed is:

1. A photographic donor material useful in forming continuous tone images in a silver salt diffusion transfer process; said donor material consisting essentially of a support; a photosensitive silver halide emulsion layer in which the silver halide is at least 80% silver chloride and is substantially free of iodide; and, located between said photosensitive silver halide emulsion layer and said support, a silver halide emulsion layer which is non-photosensitive under the conditions in which said donor material is used, said photosensitive silver halide emulsion layer having a silver laydown of from 140 to 240 $mg/m^2$ and said non-photosensitive silver halide emulsion layer having a silver laydown of from 260 to 450 $mg/m^2$.

2. A photographic donor material as claimed in claim 1 wherein the silver halide in said photosensitive emulsion layer is substantially pure silver chloride.

3. A photographic donor material as claimed in claim 1 wherein said photosensitive silver halide emulsion layer has a silver laydown of from 160 to 190 $mg/m^2$.

4. A photographic donor material as claimed in claim 1 wherein said non-photosensitive silver halide emulsion layer has a silver laydown of from 324 to 405 $mg/m^2$.

5. A photographic donor material as claimed in claim 1 wherein said non-photosensitive silver halide emulsion layer has a speed of at least 3 log E less than said photosensitive silver halide emulsion layer.

6. In a silver complex diffusion transfer process, which process comprises the steps of exposing a photographic donor material containing a photosensitive silver halide emulsion layer, developing the exposed photosensitive silver halide emulsion layer and forming a soluble silver complex of unexposed silver halide by treating said photosensitive silver halide emulsion layer with an alkaline processing fluid in the presence of a developing agent and a silver halide complexing agent, transferring said soluble silver complex by diffusion to the silver receptive layer of an image-receiving element in superposed relationship with said silver halide emulsion layer, forming at said silver receptive layer an image incorporating silver from said silver complex under the action of development nuclei, and separating said image-receiving element from said photographic donor material, the improvement wherein the photographic donor material employed in said process is as defined in claim 1.

* * * * *